United States Patent [19]

Lindström et al.

[11] 4,351,495

[45] Sep. 28, 1982

[54] THREAD-STORAGE AND DELIVERY DEVICE FOR TEXTILE MACHINES

[75] Inventors: Fred B. Lindström, Jönköping; Alf R. A. Bengtsson, Fritsla, both of Sweden

[73] Assignee: Aktiebolaget IRO, Ulricehamn, Sweden

[21] Appl. No.: 177,164

[22] Filed: Aug. 12, 1980

[30] Foreign Application Priority Data

Aug. 13, 1979 [DE] Fed. Rep. of Germany ..... 2932782

[51] Int. Cl.³ ..... B65H 51/20

[52] U.S. Cl. ..... 242/47.01; 242/47.03; 242/47.12

[58] Field of Search ..... 242/47.01, 47.03, 47.04, 242/47.05, 47.06, 47.07, 47.08, 47.09, 47.1, 47.1147.12, 47.13; 139/452; 66/132 R

[56] References Cited

U.S. PATENT DOCUMENTS

| | | | |
|---|---|---|---|
| 3,411,548 | 11/1968 | Pfarrwaller | 242/47.12 X |
| 3,759,300 | 9/1973 | Pfarrwaller | 242/47.12 X |
| 3,761,031 | 9/1973 | Pfarrwaller | 242/47.01 |
| 3,834,635 | 9/1974 | Pfarrwaller | 242/47.01 |
| 4,068,807 | 1/1978 | Jacobsson | 242/47.01 |
| 4,235,388 | 11/1980 | Jacobsson | 242/47.01 |
| 4,280,668 | 7/1981 | Lindstrom | 242/47.12 |

*Primary Examiner*—Stanley N. Gilreath

*Attorney, Agent, or Firm*—Blanchard, Flynn, Thiel, Boutell & Tanis

[57] ABSTRACT

A thread-storage and delivery device for a textile machine, wherein a hollow shaft is supported drivably for rotation on a stationary base member. The shaft drives a thread-feed member which tangentially winds the arriving thread on the surface of a stationary storage drum, from which storage drum the thread can be unwound over the drum edge through a braking ring which surrounds the drum edge and through a center removing guide which is supported on a structural part fastened on the base member, which structural part surrounds but is spaced from the storage drum. An axial guideway, for guiding therethrough a threading needle, starts adjacent to the free end of the thread feed member and continues to the removing guide. This guideway is arranged in a limited peripheral sector of the structural part. A turning handle is connected to the hollow shaft for aligning the end of the feed member with the guideway. The threading needle, in an inserted condition, extends through the hollow shaft, the feed member, the braking ring and the removing guide.

14 Claims, 4 Drawing Figures

THREAD-STORAGE AND DELIVERY DEVICE FOR TEXTILE MACHINES

BACKGROUND OF THE INVENTION

The invention relates to a thread-storage and delivery device for textile machines having an improved guideway therethrough for facilitating the insertion therethrough of a threading needle used for initially pulling the thread through the device.

To start using such a device, the end of a thread must be pulled through the device. A threading needle is used therefore, which needle consists of a flexible plastic strip of substantially rectangular cross section having a hook-shaped end, similar to a crochet needle. The threading needle is manually moved in an axial direction through the device, in most cases starting from the end of the hollow shaft located on the feed side, until the inserted end of the threading needle projects through the thread removing needle. The thread end is then suspended in the hook and is pulled through the device until the thread end also hangs out of the removing guide. To move the threading needle through the device is relatively difficult, since it must take many turns and must also be moved through the braking ring. As a rule, threading must be carried out in several steps or an auxiliary tool must be used, so that the moved-through end of the threading needle reaches its goal, namely the removing guide. To pull through a new thread can thus take substantial time, whereby the textile machine must be operated in an idling condition during this time, which means an expensive loss of production.

The basic purpose of the invention is to improve a device of the abovementioned type so that pulling through of a new thread end with the help of a threading needle can take place substantially simpler and quicker in such a device, than in conventional devices, and in which the end of the threading needle which moves through the device always reliably exits through the removing guide without any further help from outside.

In this invention, during the moving through of the end of the threading needle, same is guided and directed by the guideway all the way through the device to the removing guide. The so far necessary, difficult stoking with the needle end, or the use of an additional tool with which the needle end is moved to the correct path, is not needed. The guideway also properly guides the needle in a manner which is independent of the direction selected for moving the threading needle through the device. Handling is conceivably simple, since by means of a turning handle, only the feed member needs to be aligned with the guideway, and then the threading needle can be moved through the device without any additional control from outside. This is of particular advantage if several thread-storage and delivery devices are arranged in one group closely side-by-side and no direct access or no direct view to the path of the threading needle is possible. The guideway thereby does not influence the operational safety of the device and can be realized with technically simple means during the manufacture of the device. In cooperation with the many turns or bends of the threading needle, and due to its elasticity, same always has a tendency to remain in the guideway, until its end exits from the removing guide.

According to the present invention, there is provided a thread-storage and delivery device for a textile machine, wherein a hollow shaft is supported drivably for rotation on a stationary base member. The shaft drives a thread-feed member which tangentially winds the arriving thread on the surface of a stationary storage drum, from which storage drum the threadcan be unwound over the drum edge through a braking ring which surrounds the drum edge and through a center removing guide which is supported on a structural part fastened on the base member, which structural part surrounds but is spaced from the storage drum. An axial guideway, for guiding therethrough a threading needle, starts adjacent to the free end of the thread feed member and continues to the removing guide. This guideway is arranged in a limited peripheral sector of the structural part. A turning handle is connected to the hollow shaft for aligning the end of the feed member with the guideway. The threading needle, in an inserted condition, extends through the hollow shaft, the feed member , braking ring and the removing guide.

An advantageous embodiment of an inventive device has the guideway formed with a troughlike cross section which opens toward the storage drum. This construction of the guideway permits, due to the bending resistance of the threading needle, and without additional guide elements, permits the needle to automatically find its path from the feed member to the removing guide.

A further embodiment has a guideway section constructed on the side of a guide block arranged on the inside of a hood structural part. This guideway section on the guide block directs the threading needle between the end of the feed member and the thread-braking ring, which guide block can be fastened with simple means on the inside of the structural part.

A further advantageous embodiment of an inventive device, has the removing guide secured in a spider which is arranged on the hood. The construction of the guideway section on the inside of a spoke of the spider is simple with respect to the manufacturing technique. The alignment of the spoke with the radial position of the guide block also does not create any difficulties. The guideway section on the spoke receives the end of the threading needle immediately after penetrating through the thread-braking ring and guides same safely all the way through the removing guide.

A further advantageous embodiment of the invention includes in the guideway a concave shovel-like guide member which is connected to the feed member. The guide member is, in the area where the threading needle leaves the feed member, strongly deflected, and this is of particular importance. This contributes to a satisfactory guiding of the thread during operation, since it grips around the edge of the wobbling advancing member.

A further advantageous exemplary embodiment of the inventive device is provided with a ring which is mounted on the base member with engaging elements for counter-engaging elements of an advancing member which is supported inclined on the shaft. The end of the threading needle is hereby securely guided through between two of the engaging elements of the ring, where otherwise the danger would exist that the end of the threading needle would get hooked or wedged.

A particularly advantageous embodiment of the invention has the guideway converging in its course toward the removing guide, and wherein the path width adjacent the end of the feed member corresponds at least with the inside diameter of the feed member and adjacent to the removing guide at a maximum with its inside diameter. The converging guideway reliably grabs the end of the threading needle, which end exits from the feed member, even if the threading needle during the many turns (deflections) should get twisted or laterally moved in the hollow shaft and the feed member. During the further movement in the direction toward the removing guide, the tendency of the elastic threading needle to move laterally is increasingly corrected through the convergence of the guideway.

Since the threading needle, if it is moved in from the end of the hollow shaft, which end is on the feed side, reaches the removing guide at a relatively flat angle, it is advantageous if the removing guide is funnel-shaped at its side which faces away from the storage drum. Then the end of the threading needle exits without any hindrance from the removing guide.

As an alternative to this measure which can also be advantageous, the needle can exit in the case of a further embodiment through a coverable recess formed in the outer area of the removing guide. Then too the end of the threading needle again exits unhindered by the removing guide.

In the case of a further advantageous embodiment of an inventive device, in which the thread-braking ring and an adjusting ring which is associated with same is secured with fastening elements on the structural part or on the spider, the guide block fulfills then not only the task of the guiding of the end of the threading needle, but also acts as an abutment for the adjusting ring of the thread-braking ring. The adjusting ring can be rotated in the peripheral direction when supported on the guide block.

A further advantageous exemplary embodiment has a turning knob which is mounted on the end of the hollow shaft, which end is on the feed side end of the device, and can be simply rotated so that the feed member with its guide member is aligned exactly with the guideway.

Finally a measure which contributes to a simplified handling is provided by visible markings on the knob and on the base member. The operator can therewith, without having to look into the inside of the device, exactly align the feed members with the guideway.

BRIEF DESCRIPTION OF THE DRAWINGS

One embodiment of the invention will be discussed hereinafter in connection with the drawings, in which.

DETAILED DESCRIPTION

Figure 1:
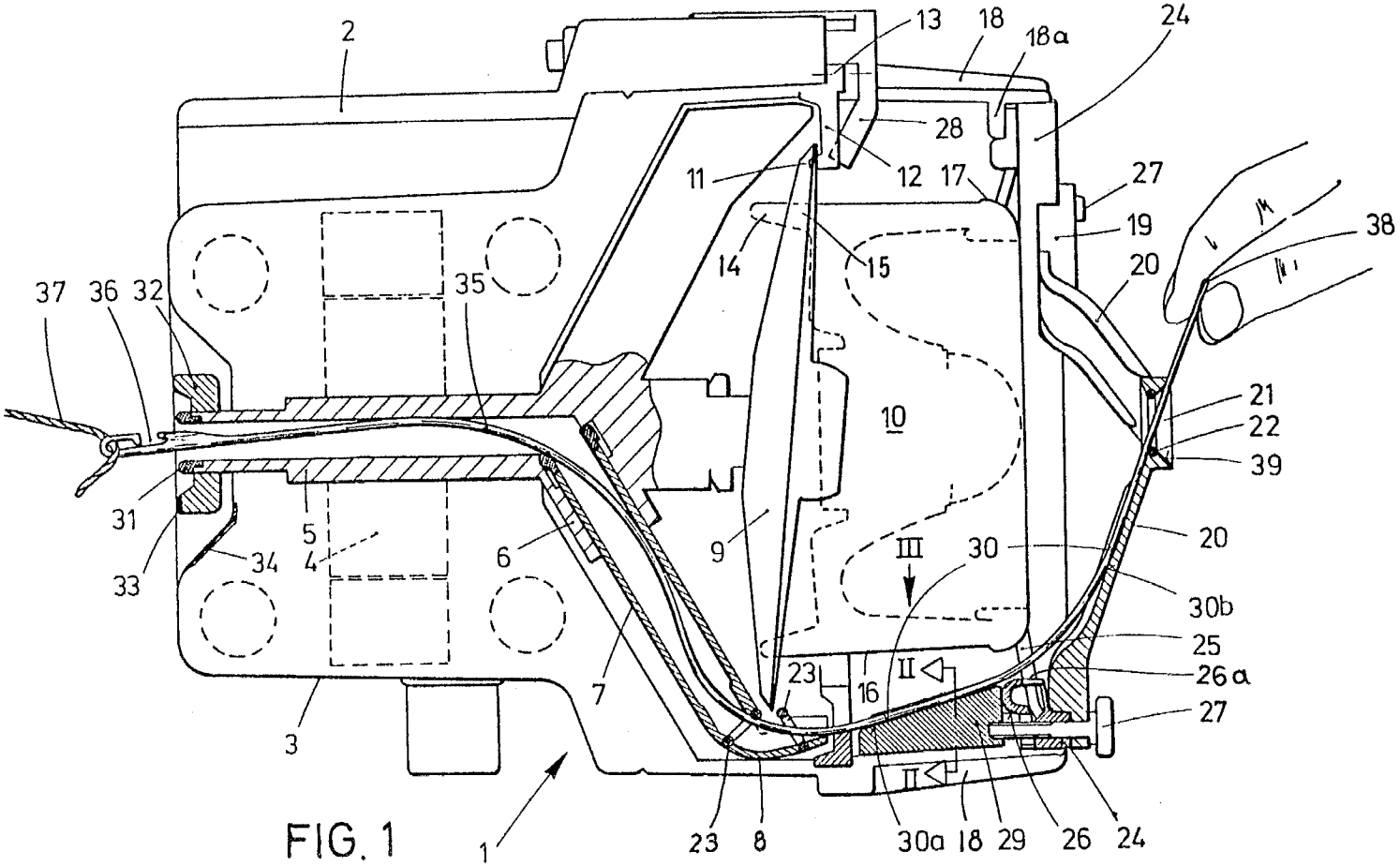
FIG. 1 is a longitudinal cross-sectional view of a thread-storage and delivery device prior to the pulling through of a thread end.

A thread storage and delivery device 1 has a drive housing 3 on a stationary base member 2, in which housing is provided a drive motor 4 for a hollow shaft 5. A radially and inclined projecting extension 6 is provided on the hollow shaft 5 inside the device, into which extension is inserted a pipe as a feed member 7. The end of the pipe has a concave guide member 8 and is equipped with common, ceramic thread guides 23. The guide member 8 wraps around the edge of an inclined advancing member 9 which is rotatably supported on the hollow shaft 5 and lies opposite but at distance from a storage drum 10 which remains stationary when the hollow shaft 5 rotates. The wobble-type advancing member 9 has on its outer circumference counter-engaging elements 11, which mate with the engaging elements 12 (i.e., radial fingers) of a ring 13 which is connected to the base member 2, namely due to the inclined position of the advancing member 9 only on a side which is diametrically opposite the feed member 7, in relationship to the axis of the hollow shaft 5.

The advancing member 9 carries on its upper side, which faces the storage drum 10, an engaging profile 15 which cooperates with a counter-engaging profile 14 of the storage drum. Upon rotation of the hollow shaft 5, the advancing member 9 is held stationary by the engagement between the elements 11 and 12, while through the engagement between the elements 14 and 15, the storage drum 10 is also held stationary. The zone of contact between the thread and the drum rotates at the shaft speed.

The storage drum 10 has a storage-drum surface 16 of a slightly conical design, which extends to a beadlike constructed drum edge 17.

The storage drum surface 16 has a stationary structural part 18 surrounding it with a radial distance therebetween, which part 18 is secured on the base member 2 and itself serves to support a spider 19 which has two spokes 20 for holding a thread-removing guide 21 in alignment with an extension of the axis of the hollow shaft 5. A common ceramic ring 22 for guiding the thread is embodied into the thread-removing guide 21. The structural part 18 can be a closed or partially open hood, or can consist of individual bars or longitudinal profiles, so that access to the drum surface is possible. An annular member 24 is secured on a projection **18*a* of the structural part 18 along with the spider 19, which annular member 24 carries a conventional thread braking ring 25 which has a plurality of comb-toothlike, elastic fingers which project radially inwardly and engage the bead 17 of the thread drum and prevent, in the usual manner, the thread from rotating with the feed member so that the feed member 7 winds the thread, as a thread storage, tangentially onto the storage-drum surface, from where it is then retarded by the braking ring 25 and is again unwound overhead through the removing guide 21**.

The fingers of the thread-braking ring 25 are tensioned by the teeth **26*a* of an adjusting ring 26, which teeth 26*a* project axially between the brake ring fingers. The ring 26 is pressed between the guide block 29 and the annular member 24 with the help of fastening elements 27 which extend through the outer edge of the spider. The adjusting ring 26 can change the initial tension of the fingers of the braking ring 25, after loosening the fastening elements 27, by rotation in a peripheral direction so that pins 26*a* effect circumferential deflection of the brake ring fingers. The guide block 29 is, in addition, secured for example on the extension 18*a* or with a fastening element (not illustrated) which extends from outside through the structural element 18**.

Figure 2:
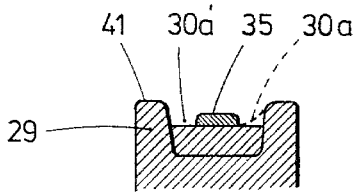
FIG. 2 is a cross-sectional view of a detail of FIG. 1 in the plane II—II.

One guideway section **30*a* or 30*b* of a guideway 30 is constructed in the side of the guide block 29, which side faces the storage-drum surface 16, and in the underside of the spoke 20 of the spider 19, which spoke 20 is in alignment with said guide block. The guideway 30 (FIG. 2) has a trough or groovelike cross section with sidewalls 41. The guide block 29 has, in the view according to FIG. 1, a wedge-shaped design so that a guideway 30 is provided which slowly rises from the end 8 of the feed member 7 and passes over the intermediate axial space occupied by the adjusting ring 26 and the braking ring 25 and which is continued through the guideway section 30*b* in the spoke 20 to the removing guide 21**.

A ceramic thread-guiding ring 31 is inserted at the feed-side end of the hollow shaft 5. Furthermore a turning knob 32 is secured nonrotatably on the end of the hollow shaft 5, which knob carries a marking 33 which is visible from the front and which is in alignment with a countermarking 34 which is provided on the drive housing 3, when the end 8 of the feed member 7 is aligned with the guideway 30.

A support 28 is furthermore secured on the base member 2, which support serves for mounting an optic sensor (not illustrated) to sense the thread storage which is placed on the storage-drum surface during the operation of the device.

A threading needle 35 is moved through the device, which needle consists of a flexible plastic or sheetmetal strip with a rectangular cross section. The rear end 36 of the threading needle 35 is formed with a hook like a crochet needle, with which hook a thread end 37 which is supposed to be threaded in can be grabbed. The front end of the threading needle 35, which end is identified with reference numeral 38, extends in the illustrated position through the removing guide 21 to the outside and can there be manually grabbed. The outside of the removing guide 21 is for this purpose enlarged with a funnel-shape 39.

To draw in a new thread end 37, the threading needle 35 is placed with its front end 38 adjacent the end of the hollow shaft 5, which end is on the feed side. This end 38 is then inserted into said hollow shaft 5 and is pushed forwardly through the feed member 7 until it extends, with the help of the guide member 8, first between two of the engaging elements 12 of the ring 13, and then along the guideway section **30*a*, being guided by same through the braking ring 25 and then guided to the outside through the removing guide 21 by the guideway section 30*b*. It can there, as illustrated, be manually grabbed. By pulling at the end 38, the threading needle 35 with the suspended thread end 37 is finally pulled through the entire device until the thread end 37 also projects through the removing guide 21. The drive motor 4 is thereafter started so that, by rotating the feed member 7, the thread storage is formed on the storage-drum surface 16. The braking ring 25 prevents the thread from rotating along between the drum edge 17 and the thread-removing guide 21**.

Figure 3:
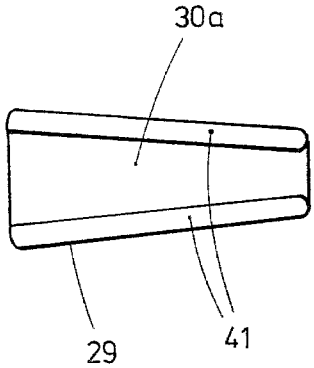
FIG. 3 is a top view of the detail of the device in direction of an arrow III in FIG. 1, which detail is cut in FIG. 2.

As can clearly be seen from FIG. 3, at least the guideway section **30*a* is constructed so as to converge in the direction toward the thread-removing guide 21**.

Figure 4:
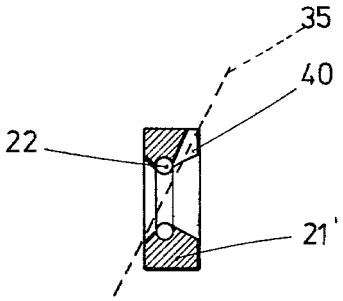
FIG. 4 illustrates a modified detail of the device according to FIG. 1.

FIG. 4 indicates a thread-removing guide 21' in which a radial recess or slot 40 is provided on the outlet side, which recess makes it easier for the threading needle 35 to pass therethrough. The recess 40 can, if desired, be closed off during operation of the device by a suitable insert piece so that the thread which moves therethrough during unwinding cannot get caught.

The threading needle 35 can also be moved through the device starting out from the removing guide 21, until the hook 36 exits at the exposed end of the hollow shaft 5, which end is on the feed side.

If the housing of the device is constructed transparent in the area of the storage drum, the markings 33 and 34 can be deleted since the operator can see whether the feed member 7 is exactly aligned with the guideway 30.

In place of the turning knob 32 it is also possible to use a different control handle which permits, from a different point of the device, the rotation of the hollow shaft 5 for aligning the feed member 7 with the guideway 30.

It has been proven to be advantageous in practice if the guideway extends over a medium angle of approximately 15° of the circumference of the hood 18.

The normal operation of the device 1 is known, being substantially the same as with the device shown in copending U.S. application Ser. No. 81 583, filed Oct. 3, 1979, now U.S. Pat. No. 4,280,668, the disclosure of which is incorporated herein by reference, so that a more detailed description of the device and of its operation is believed unnecessary.

We claim:

1. In a thread-storage and delivery device for textile machines, including a stationary base member, a hollow shaft rotatably mounted relative to the base member for driving a thread-feeding structure which includes a feed member for tangentially winding the arriving thread on the surface of a stationary storage drum, from which storage drum said thread is unwound over a drum edge at one end of the drum through a braking ring which surrounds the drum edge and through a center removing guide which is disposed adjacent said one drum end and is supported on a structural part fastened on the base member, which structural part at least partially surrounds but is spaced from the storage drum, the improvement comprising axial guideway means defining a guideway for guiding therethrough a threading needle, said guideway extending from a location adjacent to the free end of the feed member to a location adjacent said removing guide, said threading needle in an inserted condition extending through the hollow shaft, the feed member, the braking ring and the removing guide, said guideway means being disposed in a limited peripheral sector of said structural part, and a turning handle connected to the hollow shaft for aligning the end of the feed member with the guideway.

2. A thread-storage and delivery device according to claim 1, wherein the guideway means has a groovelike or troughlike cross section which opens toward the storage drum surface.

3. A thread-storage and delivery device according to claim 1, wherein a section of the guideway is constructed on the side of a guide block, which said side faces the storage-drum surface, said block being arranged on the inside of the structural part axially between the discharge end of the feed member and the thread-braking ring.

4. A thread-storage and delivery device according to claim 3, wherein the removing guide is coaxially aligned with the drum and is secured in a spider which is arranged on the structural part, which said spider has one spoke arranged in alignment with the guide block and forming on its inside a further section of said guideway.

5. A thread-storage and delivery device according to claim 3 or claim 4, wherein a concavely curved, shovel-like guide member is structurally connected to the discharge end of the feed member, which said guide member forms a part of said guideway.

6. A thread-storage and delivery device according to claim 1, wherein a ring is fixedly mounted on the base member and has engaging elements engaged with counter-engaging elements on an advancing member which is supported in an inclined position on the hollow shaft, the guideway being aligned with a space between the engaging elements of the ring and having a path so that threading needle is movably guided through between two of the engaging elements of the ring and through the brake ring and bridges the axial distance which is occupied by the thread-braking ring.

7. A thread-storage and delivery device according to claim 1, wherein the guideway converges in its course toward the removing guide, wherein the width of the guideway adjacent to the discharge end of the feed member corresponds at least with the inside diameter of the feed member and adjacent to the removing guide at a maximum corresponds with the inside diameter of the removing guide.

8. A thread-storage and delivery device according to claim 1, wherein the removing guide is enlarged funnel-shaped at its side which faces away from the storage drum.

9. A thread-storage and delivery device according to claim 8, wherein a coverable recess is formed in the outer area of the removing guide to define an extension of the guideway.

10. A thread-storage and delivery device according to claim 3 or claim 4, wherein the thread-braking ring and an adjusting ring which is associated with said braking ring are secured relative to said structural part, the guide block being clamped against the adjusting ring by a releasable tensioning element which is mounted on the structural part.

11. A thread-storage and delivery device according to claim 1 wherein the turning handle comprises a turning knob mounted on the end of the hollow shaft, which said end is on the feed side of the device.

12. A thread-storage and delivery device according to claim 11, wherein the turning knob has a visible marking which cooperates with a countermarking on the base member for alignment of the feed member with the guideway.

13. A thread-storage and delivery device according to claim 1, wherein the guideway means includes a first portion fixed to said structural part and defining thereon the first elongated section of said guideway, said first elongated section of said guideway being spaced outwardly from the surface of said storage drum and extending axially thereof, said first elongated section of said guideway opening toward the storage drum surface and having one end thereof disposed directly adjacent the discharge end of said feed member and the other end thereof disposed directly adjacent the braking ring, said hollow shaft being coaxial with and projecting outwardly from said other end of said drum, said removing guide being fixedly connected to said structural part and disposed so as to be substantially coaxially aligned and spaced axially outwardly away from said one drum end, and said guideway means including a second portion fixedly connected to said structural part and projecting axially away from said one drum end and radially inwardly so as to be fixedly connected to said removing guide, said second portion defining thereon a second elongated section of said guideway so that one end of said second elongated section terminates at said removing guide and the other end terminates adjacent said braking ring so as to be substantially aligned with the first elongated section of said guideway but spaced therefrom by the positioning of the braking ring therebetween.

14. A thread-storage and delivery device according to claim 13, wherein the feed member comprises an elongated hollow arm which is fixed to said hollow shaft and projects radially outwardly therefrom at an inclination in the axial direction toward said other end of said storage drum so that the outer end of said hollow arm defines a discharge end positioned in the vicinity of the drum surface, and said guideway means including a third portion which is fixed to the discharge end of said hollow arm and defines a curved downwardly directed deflector for alignment with one end of the guideway formed in said first portion.

* * * * *